US010640274B2

(12) United States Patent
Kim

(10) Patent No.: US 10,640,274 B2
(45) Date of Patent: May 5, 2020

(54) SHOCK-ABSORBING PACKAGING MATERIAL HAVING MULTI-LAYERED AIR CELLS

(71) Applicant: Reco Co., Ltd., Hwaseong-si, Gyeonggi-do (KR)

(72) Inventor: Young Soo Kim, Hanam-si (KR)

(73) Assignee: Reco Co., Ltd., Hwaseong-si, Gyeonggi-do (KR)

( * ) Notice: Subject to any disclaimer, the term of this patent is extended or adjusted under 35 U.S.C. 154(b) by 102 days.

(21) Appl. No.: 15/563,025

(22) PCT Filed: Dec. 17, 2015

(86) PCT No.: PCT/KR2015/013873
§ 371 (c)(1),
(2) Date: Sep. 29, 2017

(87) PCT Pub. No.: WO2016/159487
PCT Pub. Date: Oct. 6, 2016

(65) Prior Publication Data

US 2018/0370709 A1 Dec. 27, 2018

(30) Foreign Application Priority Data

Mar. 31, 2015 (KR) ..... 10-2015-0044790

(51) Int. Cl.
*B65D 81/05* (2006.01)
*B65D 81/03* (2006.01)

(52) U.S. Cl.
CPC ..... *B65D 81/052* (2013.01); *B65D 81/03* (2013.01); *B65D 81/05* (2013.01)

(58) Field of Classification Search
CPC ..... B65D 81/052; B65D 81/03; B65D 81/05
(Continued)

(56) References Cited

U.S. PATENT DOCUMENTS 4,262,045 A * 4/1981 Cheng ..... B32B 3/12 428/69
5,270,092 A * 12/1993 Griffith ..... B32B 3/12 428/69

(Continued)

FOREIGN PATENT DOCUMENTS

JP 2008-050022 A 3/2008
JP 2014-133588 A 7/2014

(Continued)

OTHER PUBLICATIONS

International Search Report dated Apr. 15, 2016, issued in corresponding International Application No. PCT/KR2015/013873, filed Dec. 17, 2015, 5 pages.

*Primary Examiner* — Ernesto A Grano
(74) *Attorney, Agent, or Firm* — Christensen O'Connor Johnson Kindness PLLC

(57) ABSTRACT

The present disclosure relates to a shock-absorbing packaging material having multi-layered air cells. Between outer covers forming air cells, an auxiliary inner cover is provided to be fused alternately and partially with the outer covers and thus form air cells of a multi-layered structure, which are alternately stacked between the outer covers. When packaging an article using the shock-absorbing packaging material, it is possible to more safely protect the article due to an enhancement in shock-absorbency through the air cells of a multi-layered structure. Moreover, the structure of the air cells of a multi-layered structure, which are alternately stacked, may effectively block heat transfer between the inside and the outside of the packaging material through portions where the air cells are connected with each other, whereby the shock-absorbing packaging material having multi-layered air cells may be useful for packaging an article which needs to be kept warm or cold.

6 Claims, 9 Drawing Sheets

(58) Field of Classification Search
USPC ..... 206/522
See application file for complete search history.

(56) References Cited

U.S. PATENT DOCUMENTS

| | | | | |
|---|---|---|---|---|
| 6,755,568 | B2 * | 6/2004 | Malone | B29C 65/18 206/522 |
| 8,021,734 | B2 * | 9/2011 | Lippy | B29D 22/02 428/76 |
| 8,205,750 | B2 | 6/2012 | Kim | |
| 2003/0128898 | A1 * | 7/2003 | Malone | B65D 81/052 383/3 |
| 2006/0000176 | A1 | 1/2006 | Taylor | |
| 2006/0251833 | A1 * | 11/2006 | Gavin | B32B 27/08 428/34.1 |
| 2007/0051655 | A1 * | 3/2007 | Yoshifusa | B65D 81/052 206/522 |
| 2007/0084745 | A1 * | 4/2007 | Yoshifusa | B65D 81/052 206/522 |
| 2007/0170084 | A1 * | 7/2007 | Chen | B65D 81/052 206/522 |
| 2009/0050509 | A1 * | 2/2009 | Liao | B65D 81/052 206/522 |
| 2009/0105721 | A1 | 4/2009 | Larkin | |
| 2010/0072103 | A1 * | 3/2010 | Watanabe | B65D 81/03 206/522 |
| 2010/0101970 | A1 * | 4/2010 | Frayne | B31D 5/0073 206/522 |
| 2011/0233101 | A1 * | 9/2011 | Baines | B65D 81/052 206/522 |
| 2013/0292289 | A1 * | 11/2013 | Zhang | F16K 15/147 206/522 |
| 2013/0313152 | A1 * | 11/2013 | Liao | B65D 81/052 206/522 |

FOREIGN PATENT DOCUMENTS

| | | | |
|---|---|---|---|
| KR | 10-0878138 | B1 | 1/2009 |
| KR | 10-0936160 | B1 | 1/2010 |
| KR | 20-0464220 | Y1 | 12/2012 |

* cited by examiner

SHOCK-ABSORBING PACKAGING MATERIAL HAVING MULTI-LAYERED AIR CELLS

TECHNICAL FIELD

The present disclosure relates to a shock-absorbing packaging material having multi-layered air cells. More specifically, between a pair of outer covers forming air cells of a shock-absorbing packaging material, at least one auxiliary inner cover is provided in such a way as to be fused alternately and partially with the pair of outer covers and thus form a plurality of air cells of a multi-layered structure, which are alternately stacked between the pair of outer covers. As such, when packaging an article using the shock-absorbing packaging material, it is possible to more safely protect the article due to an enhancement in shock-absorbency through the air cells of a multi-layered structure. Moreover, the structure of the air cells of a multi-layered structure, which are alternately stacked, may effectively block heat transfer between the inside and the outside of the packaging material through portions where the air cells are connected with each other, whereby the shock-absorbing packaging material having multi-layered air cells according to the present disclosure may be useful for packaging an article which needs to be kept warm or cold.

BACKGROUND ART

In general, when there is a possibility of an article to be damaged due to a load by other goods, an external shock, an internal vibration or the like in the course of loading and transporting goods, the article is protected by inserting a shock-absorbing packaging material between the article and a packaging box. Since such a shock-absorbing packaging material is usually placed to surround the outer surface of the article, an elasticity and a strength are required in addition to a light weight to protect the article.

In recent years, in order to ensure easy processability in conformity with various articles and effectively support a shock transferred from an exterior or the load of an article so as to allow the article to be transported to a destination without being broken, an air cell type shock-absorbing packaging material in which air is filled in a film is being widely used.

FIGS. 1 to 3 are views illustrating a shock-absorbing packaging material according to the conventional art, wherein FIG. 1 is an exploded perspective view illustrating the shock-absorbing packaging material, FIG. 2 is an assembled perspective view of FIG. 1 and FIG. 3 is a view illustrating the shock-absorbing packaging material filled with air.

Referring to FIGS. 1 and 2, a shock-absorbing packaging material 1 according to the conventional art is constructed by an upper outer cover 10 and a lower outer cover 20 which are mutually partially fused to form an air introduction path 16 through which air is introduced from an exterior and which form air cells 15 which communicate with the air introduction path 16 through air guide paths 32 and are filled with air, and an upper inner cover 30 and a lower inner cover 40 which are interposed between the upper outer cover 10 and the lower outer cover 20 to form the air guide paths 32 between the air introduction path 16 and the air cells 15.

That is to say, in the shock-absorbing packaging material 1, the upper and lower inner covers 30 and 40 are inserted between the upper and lower outer covers 10 and 20 to overlap with each other, and the upper outer cover 10, the upper inner cover 30 and the lower inner cover 40 are partially fused at regular intervals in a longitudinal direction to form internal fused portions 31. In this way, the upper outer cover 10 and the upper inner cover 30 are fused to each other, and the air guide paths 32 are formed between the upper inner cover 30 and the lower inner cover 40. Passages which connect the air introduction path 16 and the air guide paths 32 are formed where backing members 41 are disposed at the internal fused portions 31.

After that, longitudinal fused portions 11 are formed at regular intervals by simultaneously fusing the upper and lower outer covers 10 and 20 and the upper and lower inner covers 30 and 40, and the plurality of air cells 15 are formed by finishing through first and second transverse fused portions 12 and 13 at the front and rear ends of the longitudinal fused portions 11. A third transverse fused portion 14 is formed along the front edges of the upper and lower outer covers 10 and 20 forwardly of the first transverse fused portion 12. The third transverse fused portion 14 forms the air introduction path 16 in cooperation with the first transverse fused portion 12.

One end of the air introduction path 16 formed in this way defines an air introduction opening 17 which is open to allow air to be introduced, and the other end of the air introduction path 16 is closed by extending an outermost longitudinal fused portion 11.

In the above-described construction, if an air introduction nozzle is inserted into the air introduction opening 17 of the shock-absorbing packaging material 1 illustrated in FIG. 2 and air is introduced through the air introduction opening 17, air introduced through the air introduction opening 17 is filled in the air cells 15 by passing through the air guide paths 32 via the air introduction path 16. In this way, as illustrated in FIG. 3, the shock-absorbing packaging material 1 in which air is filled in the air cells 15 is completed finally.

Shock-absorbing packaging materials of such a structure are disclosed in Korean Unexamined Patent Publication No. 2009-0105721 entitled "Air bag" and Korean Unexamined Patent Publication No. 2006-0000176 entitled "A packing material which absorbs shock by injected air and a method thereof." When packaging an article using such a shock-absorbing packaging material, the shock-absorbing packaging material filled with air is disposed to surround the outer surface of the article so as to allow the article to be accommodated in the shock-absorbing packaging material, whereby it is possible to easily protect the article through the shock-absorbing function of air cells.

Further, such a shock-absorbing packaging material may perform not only the function of protecting an article but also the function of keeping a packaged article warm or cold through air cells. Therefore, the shock-absorbing packaging material may be used to package an article which needs to be kept warm or cold.

However, in the case where the conventional shock-absorbing packaging material 1 is used for keeping an article warm or cold, a problem may be caused in that, since heat transfer may easily occur between the inside and the outside of the shock-absorbing packaging material 1 through the longitudinal fused portions 11 formed between the air cells 15, it is difficult to obtain a desired effect of keeping warm or cold.

Furthermore, in the above-described conventional shock-absorbing packaging material 1, when packaging an article, although a shock-absorbing function for the article is provided through the plurality of air cells 15 which are successively formed in a transverse direction, since the air cells 15 are formed in only one layer, shock-absorbency relatively degrades in comparison with a multi-layered air cell structure. Moreover, in the case where an external shock is transferred through a longitudinal fused portion 11 formed between air cells 15, a problem may be caused in that the article is likely to be broken.

DISCLOSURE

Technical Problem

The present disclosure has been made to solve the above problems occurring in the related art, and is directed to providing a shock-absorbing packaging material having multi-layered air cells wherein, between a pair of outer covers forming air cells of a shock-absorbing packaging material, at least one auxiliary inner cover is provided in such a way as to be fused alternately and partially with the pair of outer covers and thus form a plurality of air cells of a multi-layered structure, which are alternately stacked between the pair of outer covers, and as such, when packaging an article using the shock-absorbing packaging material, it is possible to more safely protect the article due to an enhancement in shock-absorbency through the air cells of a multi-layered structure and moreover the structure of the air cells of a multi-layered structure, which are alternately stacked, may effectively block heat transfer between the inside and the outside of the packaging material through portions where the air cells are connected with each other, whereby the shock-absorbing packaging material having multi-layered air cells according to the present disclosure may be useful for packaging an article which needs to be kept warm or cold.

Technical Solution

In an embodiment, a shock-absorbing packaging material may include: an upper outer cover and a lower outer cover partially fused to each other, forming air cells therebetween, and forming an air introduction path through which air is introduced from an exterior, forwardly of front ends of the air cells; and an upper inner cover and a lower inner cover interposed between the upper outer cover and the lower outer cover, partially fused to each other, and forming a plurality of air guide paths between the air introduction path and the air cells, wherein at least one auxiliary inner cover which is partially fused to the upper outer cover and the lower outer cover in an alternately staggered manner is disposed between the upper outer cover and the lower outer cover where the air cells are formed, thereby forming the air cells formed between the upper outer cover and the lower outer cover as a plurality of air cells of a multi-layered structure which are stacked in an alternately staggered manner, and wherein each of the upper outer cover, the lower outer cover and the auxiliary inner cover is formed of any one among 1) a synthetic resin film in which a polyethylene (PE) film and a polyethylene terephthalate (PET) film deposited with aluminum are laminated, 2) a synthetic resin film in which a polyethylene (PE) film, an aluminum (Al) film and a polyethylene terephthalate (PET) film are laminated, 3) a synthetic resin film in which a polyethylene (PE) film, a silica film and a nylon film are laminated and 4) a synthetic resin film in which a polyethylene (PE) film and a urethane film are laminated.

Advantageous Effects

In the shock-absorbing packaging material having multi-layered air cells according to the present disclosure, by forming therein a plurality of air cells of a multi-layered structure which are alternately stacked, when packaging an article using the shock-absorbing packaging material, shock-absorbency is increased through the structure of the air cells of a multi-layered structure, whereby it is possible to more safely protect the packaged article.

In addition, in the case of packaging an article which needs to be kept ward or cold, since heat transfer between the inside and the outside of the shock-absorbing packaging material through portions where the air cells are connected with each other is effectively blocked, an advantage may be provided in that an effect of keeping warm and cold is excellent.

MODE FOR INVENTION

Figure 1:
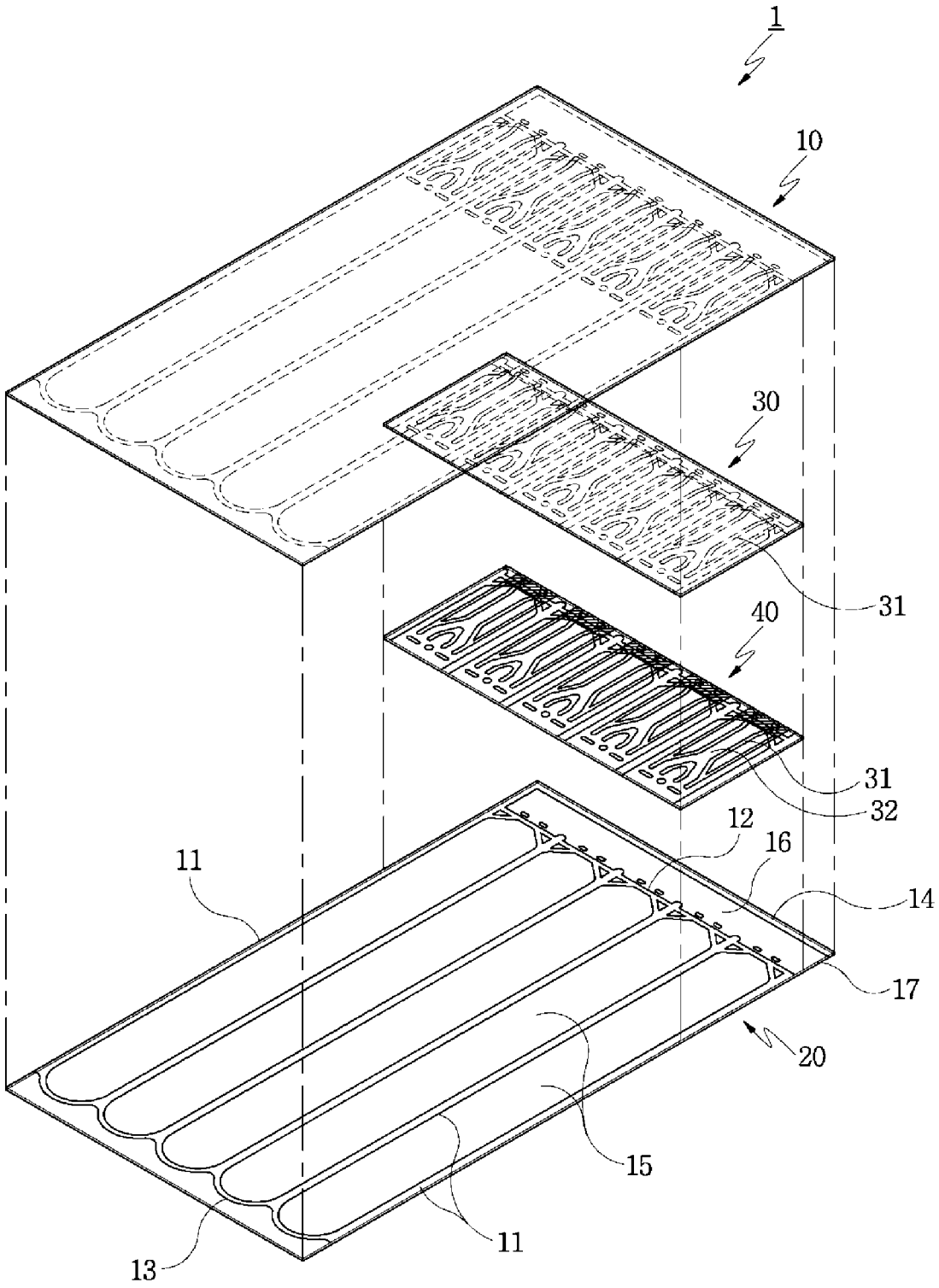
FIGS. 1 to 3 are views illustrating a shock-absorbing packaging material according to the conventional art.
Figure 2:
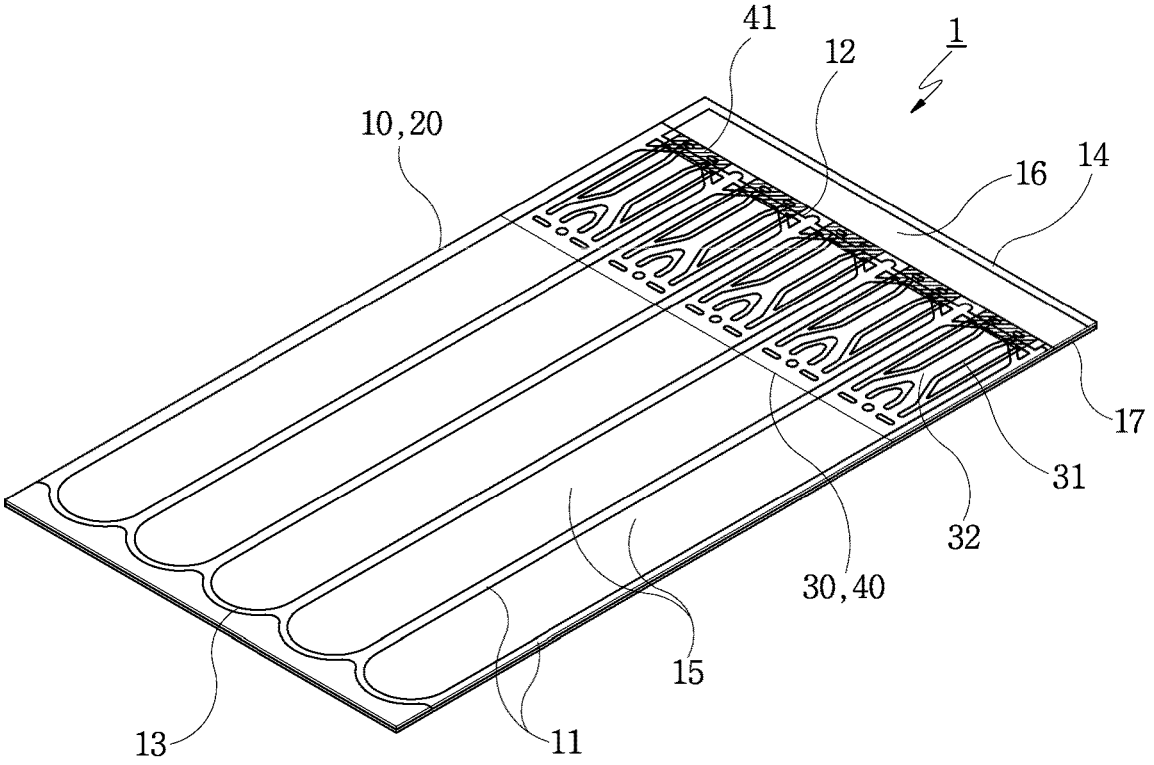
Figure 3:
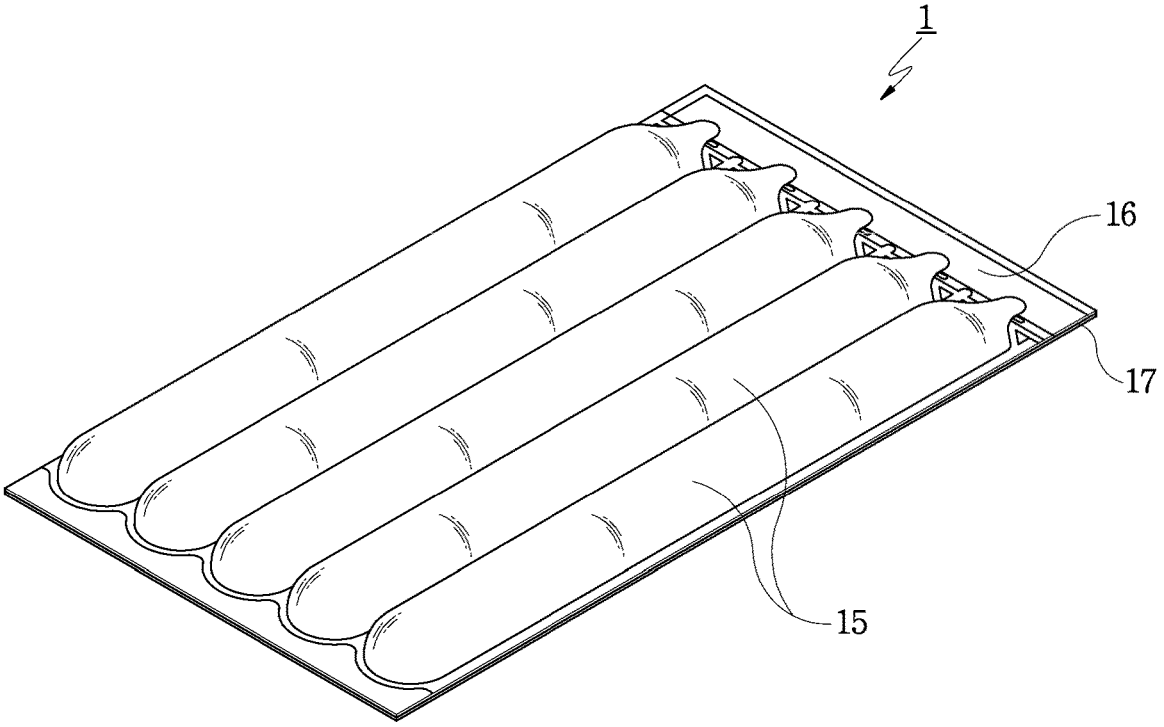

Hereafter, embodiments of the present disclosure will be described in detail, but it is to be noted that the present disclosure is not limited to the following embodiments without departing from the gist of the present disclosure.

Prior to making descriptions, it is to be noted that the terms 'upper,' 'lower,' 'front end' and 'rear end' to be mentioned in the following descriptions are terms that are selected on the basis of the drawings to facilitate the understanding of the present disclosure. In a shock-absorbing packaging material illustrated in FIGS. 4 and 5, according to a stacking sequence of outer covers or inner covers, a lower portion will be explained by using the term 'lower' and an upper portion will be explained by using the term 'upper,' and the upper ends of the air cells 135 in which air guide paths 142 are formed will be explained by using the term 'front end' and the lower ends of the air cells 135 opposite to the upper ends will be explained by using the term 'rear end.'

In addition, in the drawings, the short-width sides of the air cells represent a transverse direction and the long-width sides of the air cells represent a longitudinal direction, and the solid lines shown inside sheets (an upper outer cover, a lower outer cover, an auxiliary inner cover, an upper inner cover and a lower inner cover) indicate fused portions which are formed on upper surfaces and the dotted lines indicate fused portions which are formed on lower surfaces.

Moreover, a shock-absorbing packaging material having multi-layered air cells according to the present disclosure is a shock-absorbing packaging material having multi-layered air cells in which a plurality of air cells are stacked in an alternately staggered manner. Hereunder, descriptions for the construction of a shock-absorbing packaging material having two-layered air cells will be made in a first embodiment, and descriptions for the construction of a shock-absorbing packaging material having three-layered air cells will be made in a second embodiment.

While shock-absorbing packaging materials having a two-layered air cell structure and a three-layered air cell structure will be described in the embodiments of the present disclosure, it is to be noted as a matter of course that a shock-absorbing packaging material having an at least four-layered air cell structure may be formed through the construction of an auxiliary inner cover to be described later.

Figure 4:
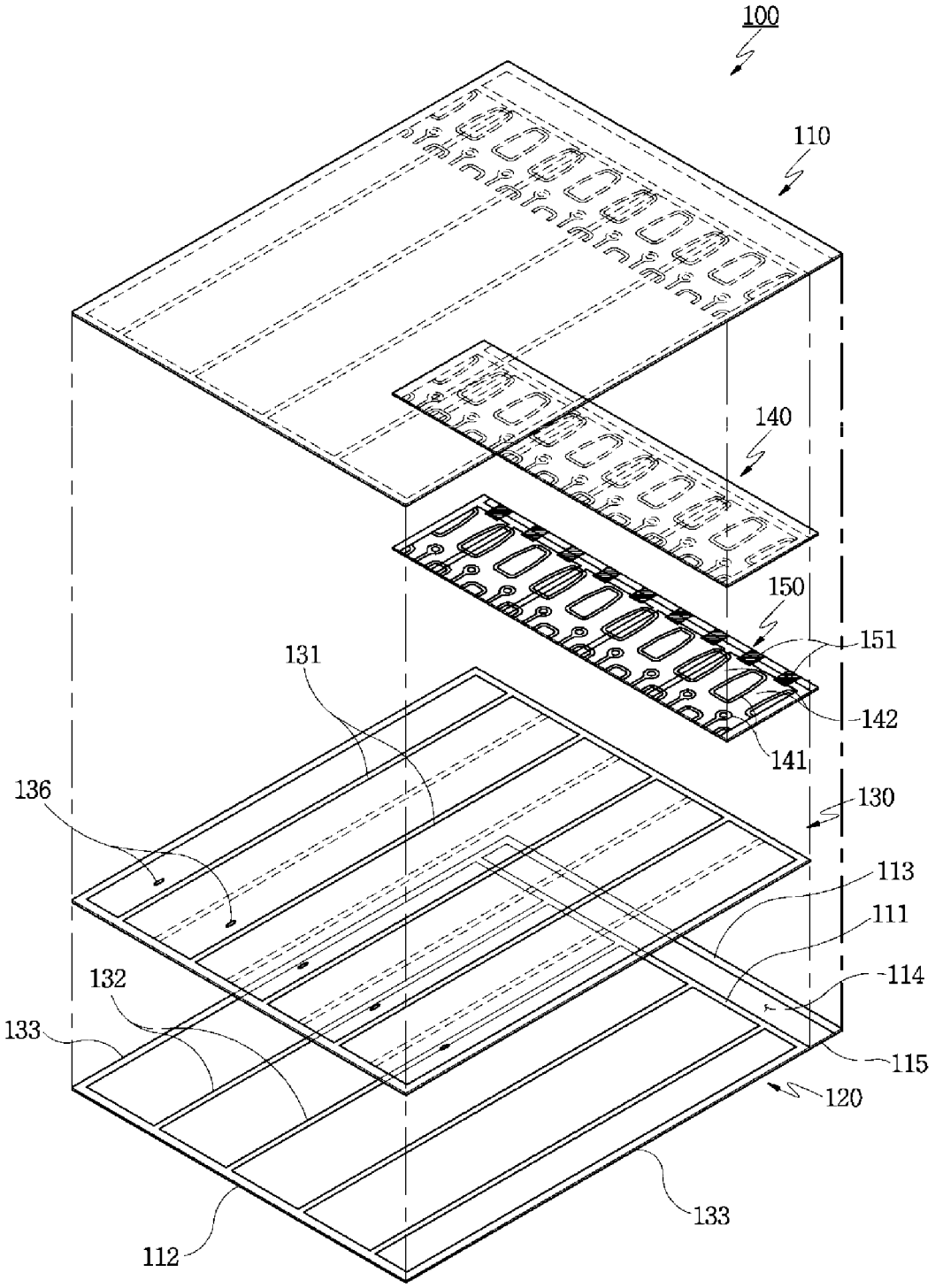
FIG. 4 is an exploded perspective view illustrating the construction of a shock-absorbing packaging material having multi-layered air cells in accordance with a first embodiment of the present disclosure.
Figure 5:
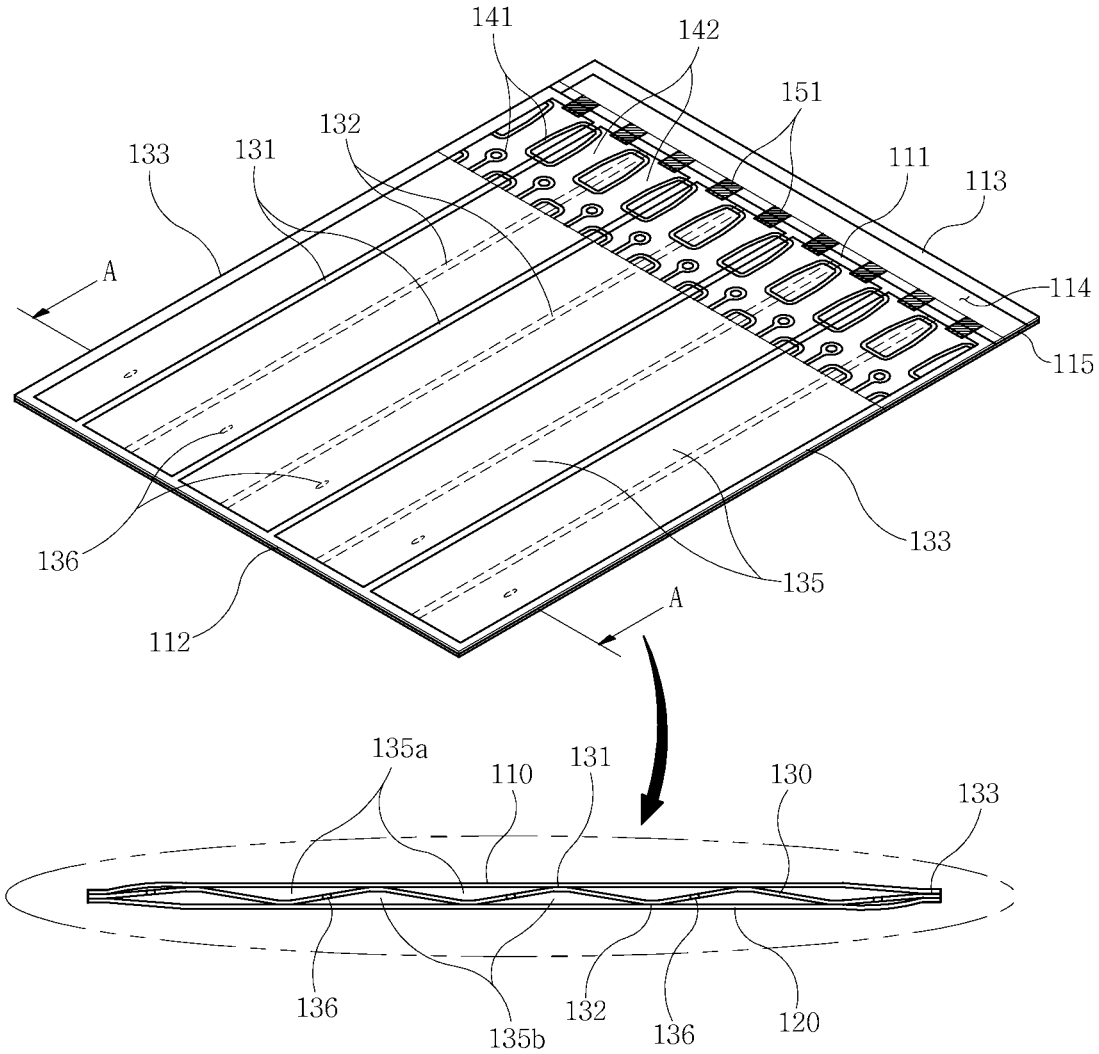
FIG. 5 is an assembled perspective view illustrating the construction of the shock-absorbing packaging material having multi-layered air cells in accordance with the first embodiment of the present disclosure.
Figure 6:
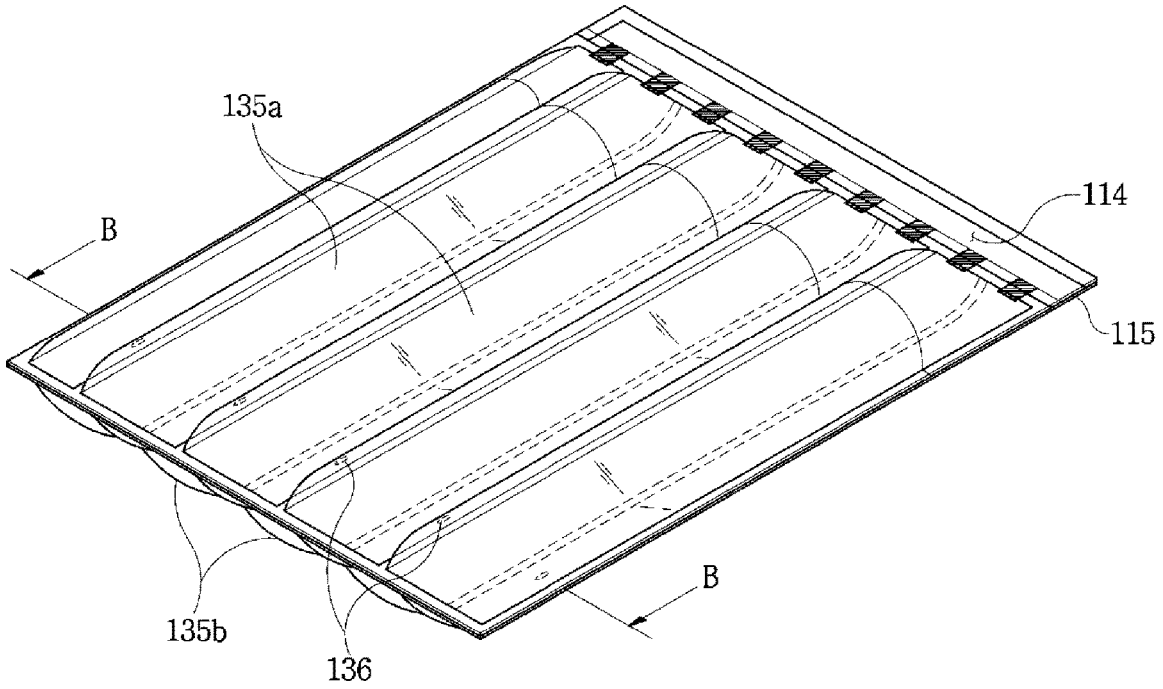
FIG. 6 is a view illustrating a state in which air is filled in the shock-absorbing packaging material having multi-layered air cells in accordance with the first embodiment of the present disclosure.
Figure 7:
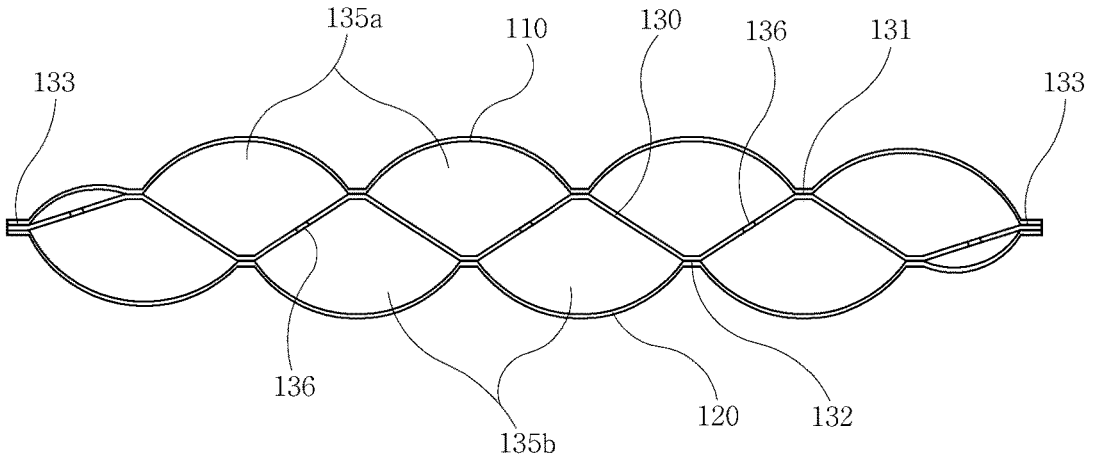
FIG. 7 is a cross-sectional view taken along the line B-B of FIG. 6, illustrating the structure of the air cells of the shock-absorbing packaging material which is in an air-filled state, in accordance with the first embodiment of the present disclosure.

FIG. 4 is an exploded perspective view illustrating the construction of a shock-absorbing packaging material having multi-layered air cells in accordance with a first embodiment of the present disclosure, FIG. 5 is an assembled perspective view illustrating the construction of the shock-absorbing packaging material having multi-layered air cells in accordance with the first embodiment of the present disclosure, FIG. 6 is a view illustrating a state in which air is filled in the shock-absorbing packaging material having multi-layered air cells in accordance with the first embodiment of the present disclosure, and FIG. 7 is a cross-sectional view taken along the line B-B of FIG. 6, illustrating the structure of the air cells of the shock-absorbing packaging material which is in an air-filled state, in accordance with the first embodiment of the present disclosure.

As shown in FIGS. 4 to 7, a shock-absorbing packaging material 100 having multi-layered air cells in accordance with a first embodiment of the present disclosure is constructed by including an upper outer cover 110 and a lower outer cover 120 which are partially fused to each other, form air cells 135 therein and form, forwardly of the front ends of the air cells 135, an air introduction path 114 through which air is introduced from an exterior; and an upper inner cover 140 and a lower inner cover 150 which are interposed between the upper outer cover 110 and the lower outer cover 120, are partially fused to each other and form a plurality of air guide paths 142 between the air introduction path 114 and the air cells 135. One fold of auxiliary inner cover 130 which is partially fused alternately to the upper outer cover 110 and the lower outer cover 120 is disposed between the upper outer cover 110 and the lower outer cover 120 where the air cells 135 are formed, such that the air cells 135 which are formed between the upper outer cover 110 and the lower outer cover 120 are divided into a plurality of air cells 135*a* and 135*b* of a two-layered structure which are stacked in an alternately staggered manner.

In the shock-absorbing packaging material having multi-layered air cells constructed as mentioned above, between a pair of outer covers (upper and lower outer covers) constructing the shock-absorbing packaging material, at least one auxiliary inner cover is provided in such a way as to be partially fused in an alternately staggered manner to the pair of outer covers and thus form a plurality of air cells of a multi-layered structure, which are stacked in the alternately staggered manner between the pair of outer covers. As such, advantages may be provided in that, when packaging an article using the shock-absorbing packaging material, it is possible to more safely protect the article due to an enhancement in shock-absorbency through the air cells of the multi-layered structure. Moreover, the structure of the air cells of the multi-layered structure, which are stacked in the alternately staggered manner, may effectively block heat transfer between the inside and the outside of the packaging material through portions where the air cells are connected with each other, whereby the shock-absorbing packaging material having multi-layered air cells according to the present disclosure may be useful for packaging an article which needs to be kept warm or cold.

Hereinbelow, the respective components of the shock-absorbing packaging material having multi-layered air cells in accordance with the first embodiment, constructed as mentioned above, will be described in detail. The upper outer cover 110 and the lower outer cover 120 are made of films of synthetic resin or the like and have the same size.

The auxiliary inner cover 130 as an inner cover which is provided to form the plurality of air cells 135 of a two-layered structure between the upper outer cover 110 and the lower outer cover 120 may be made of the same film of synthetic resin or the like as the upper outer cover 110 and the lower outer cover 120.

The auxiliary inner cover 130 is formed to have the same length as the upper outer cover 110 and the lower outer cover 120 in the transverse direction and is formed to have a shorter length than the upper outer cover 110 and the lower outer cover 120 in the longitudinal direction.

The upper inner cover 140 and the lower inner cover 150 are provided to be interposed between the upper outer cover 110 and the auxiliary inner cover 130 and play the role of valves which open and close the air guide paths 142 communicating with the air cells 135. The upper inner cover 140 and the lower inner cover 150 are also made of films of synthetic resin or the like. The upper inner cover 140 and the lower inner cover 150 are formed to have the same length as the upper outer cover 110, the lower outer cover 120 and the auxiliary inner cover 130 in the transverse direction and are formed to have a shorter length than the auxiliary inner cover 130 in the longitudinal direction.

Backing members 151 which prevent fusion are formed at regular intervals along the front edge of the lower inner cover 150. The backing members 151 play the role of preventing portions to form air introduction passages from being fused to each other when fusing the upper and lower inner covers 140 and 150.

As described above, in the shock-absorbing packaging material 100 having multi-layered air cells in accordance with the first embodiment of the present disclosure, by partially fusing the upper and lower outer covers 110 and 120, the auxiliary inner cover 130 and the upper and lower inner covers 140 and 150, the air introduction path 114, the air guide paths 142 and the plurality of air cells 135 of the two-layered structure are formed. The constructions and the manufacturing processes thereof are as follows.

As shown in FIGS. 4 and 5, after stacking the auxiliary inner cover 130 on the lower outer cover 120, stacking the overlapped upper and lower inner covers 140 and 150 on the auxiliary inner cover 130 and then stacking the upper outer cover 110 on the upper and lower inner covers 140 and 150, the lower outer cover 120, the auxiliary inner cover 130, the overlapped upper and lower inner covers 140 and 150 and the upper outer cover 110 sequentially stacked in this way are partially fused.

In this regard, in the fusing process, first, the upper outer cover 110, the upper inner cover 140 and the lower inner cover 150 are partially fused at regular intervals in the longitudinal direction to form internal fused portions 141, such that the upper outer cover 110 and the upper inner cover 140 are fused to each other and the plurality of air guide paths 142 are formed between the upper inner cover 140 and the lower inner cover 150.

The air introduction passages which allow the air introduction path 114 and the air guide paths 142 to communicate with each other are formed where the backing members 151 are disposed at the internal fused portions 141.

Thereafter, the auxiliary inner cover 130 is partially fused to the underside of the upper outer cover 110 to which the upper and lower inner covers 140 and 150 are fused, to form first longitudinal fused portions 131 at regular intervals, and the lower outer cover 120 is partially fused to the underside of the auxiliary inner cover 130 to form second longitudinal fused portions 132 at regular intervals in an alternately staggered manner with respect to the first longitudinal fused portions 131.

That is to say, as illustrated in FIG. 5, the second longitudinal fused portions 132 are formed by fusing the auxiliary inner cover 130 and the lower outer cover 120 in the longitudinal direction along middle lines between the first longitudinal fused portions 131 where the upper outer cover 110 and the auxiliary inner cover 130 are fused at regular intervals. As a consequence, as illustrated in the cross-sectional view of FIG. 5 taken along the line A-A of the perspective view of FIG. 5, the auxiliary inner cover 130 divides the space between the upper outer cover 110 and the lower outer cover 120 in a zigzag pattern by the first longitudinal fused portions 131 and the second longitudinal fused portions 132.

In the state in which, as described above, the auxiliary inner cover 130 is fused between the upper outer cover 110 and the lower outer cover 120 by the first and second longitudinal fused portions 131 and 132, both transverse ends of the upper outer cover 110, the upper inner cover 140, the lower inner cover 150, the auxiliary inner cover 130 and the lower outer cover 120 which overlap with one another are simultaneously fused to form third longitudinal fused portions 133 and thereby finish both transverse ends of the shock-absorbing packaging material 100, and first and second transverse fused portions 111 and 112 are formed at and thereby finish the front ends and the rear ends of the first to third longitudinal fused portions 131, 132 and 133, whereby the plurality of air cells 135 are formed.

The plurality of air cells 135 formed in this way are formed in a two-layered structure in which an upper layer and a lower layer are stacked in an alternately staggered manner between the upper outer cover 110 and the lower outer cover 120, as illustrated in the cross-sectional view taken along the line A-A of FIG. 5, by finishing through fusing the front ends and the rear ends of the first to third longitudinal fused portions 131, 132 and 133 by the first and second transverse fused portions 111 and 112, in the state in which the auxiliary inner cover 130 divides the space between the upper outer cover 110 and the lower outer cover 120 in the zigzag pattern by the first to third longitudinal fused portions 131, 132 and 133.

Further, a third transverse fused portion 113 is formed along the front edges of the upper and lower outer covers 110 and 120 forwardly of the first transverse fused portion 111. The third transverse fused portion 113 forms the air introduction path 114 in cooperation with the first transverse fused portion 111.

The air introduction path 114 communicates with the plurality of air guide paths 142 through the air introduction passages which are formed by the backing members 151 of the upper and lower inner covers 140 and 150. The air introduction passages and the air guide paths 142 may be formed at portions of the upper and lower inner covers 140 and 150 which do not overlap with the first to third longitudinal fused portions 131, 132 and 133.

The plurality of air guide paths 142 are formed between the upper and lower inner covers 140 and 150 which are fused to the upper outer cover 110, and communicate with only the plurality of air cells 135*a* which are formed at the upper layer among the plurality of air cells 135 formed in the two-layered structure and stacked in the alternately staggered manner. Due to this fact, as illustrated in FIG. 5, a plurality of air flow holes 136 may be formed through the auxiliary inner cover 130 between the air cells 135*a* of the upper layer and the air cells 135*b* of the lower layer such that air introduced into the air cells 135*a* of the upper layer through the air guide paths 142 may flow also into the air cells 135*b* of the lower layer.

As illustrated in FIGS. 5 and 7, since each of the plurality of air flow holes 136 is formed to communicate with a pair of air cells 135*a* and 135*b* which are disposed up and down, among the plurality of air cells 135 formed in the two-layered structure, even in the case where any one air cell pops in the shock-absorbing packaging material 100, an influence is not exerted on the other air cells except an air cell paired and communicated with the popped air cell through a corresponding air flow hole 136.

By the above-described construction, if an air introduction nozzle is inserted into an air introduction opening 115 of the shock-absorbing packaging material 100 illustrated in FIG. 5 and air is introduced through the air introduction opening 115, as illustrated in FIGS. 6 and 7, air introduced through the air introduction opening 115 is filled in the plurality of air cells 135*a* formed at the upper layer among the plurality of air cells 135 formed in the two-layered structure, by passing through the air guide paths 142 via the air introduction path 114, and at the same time, air is filled also in the plurality of air cells 135*b* formed at the lower layer, through the plurality of air flow holes 136 formed through the auxiliary inner cover 130.

As a consequence, in the shock-absorbing packaging material having multi-layered air cells in accordance with the first embodiment of the present disclosure, by partially fusing an auxiliary inner cover between an upper outer cover and a lower outer cover, a plurality of air cells of a two-layered structure are formed such that the air cells are stacked between the upper outer cover and the lower outer cover in an alternately staggered manner. Therefore, when packaging an article using the shock-absorbing packaging material, it is possible to more safely protect the article due to an enhancement in shock-absorbency through the air cells of the two-layered structure.

Moreover, through the two-layered air cell structure in which the air cells are stacked in the alternately staggered manner, heat transfer between the inside and the outside of the packaging material through portions where the air cells are connected with each other may be effectively blocked, whereby the excellent effect of keeping an article warm or cold may be provided when packaging the article and thus the shock-absorbing packaging material in accordance with the first embodiment of the present disclosure may be useful for packaging an article which needs to be kept warm or cold.

When constructing the above-described shock-absorbing packaging material according to the present disclosure, in order to increase the effect of keeping an article warm or cold, it may be more effective to use a synthetic resin film containing a hest insulating material instead of an ordinary synthetic resin film.

In other words, in a conventional shock-absorbing packaging material, it is the norm that a synthetic resin film in which a polyethylene (PE) film and a nylon film having an excellent gas barrier property are laminated is used. In the shock-absorbing packaging material according to the present disclosure, the synthetic resin film in which a polyethylene (PE) film and a nylon film are laminated may be applied, and, besides, in order to increase the effect of keeping an article warm or cold, various synthetic resin films for keeping an article warm or cold, such as i) a synthetic resin film in which a polyethylene (PE) film and a polyethylene terephthalate (PET) film deposited with aluminum are laminated, ii) a synthetic resin film in which a polyethylene (PE) film, an aluminum (Al) film and a polyethylene terephthalate (PET) film are laminated, iii) a synthetic resin film in which a polyethylene (PE) film, a silica film and a nylon film are laminated and iv) a synthetic resin film in which a polyethylene (PE) film and a urethane film are laminated, may be applied.

Figure 8:
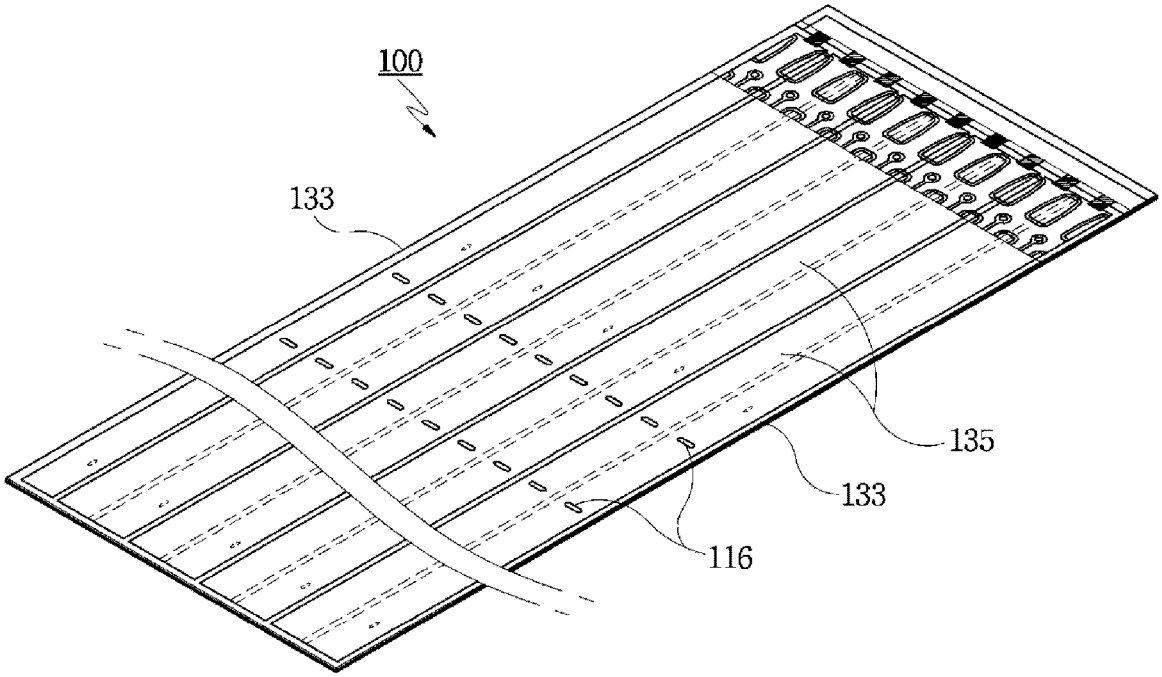
FIG. 8 is a view illustrating a state in which spot fused portions are formed in the air cells of the shock-absorbing packaging material in accordance with the first embodiment of the present disclosure.

FIG. 8 is a view illustrating a state in which spot fused portions are formed in the air cells of the shock-absorbing packaging material in accordance with the first embodiment of the present disclosure. In the shock-absorbing packaging material 100 having multi-layered air cells constructed as mentioned above, spot fused portions 116 which fuse the upper outer cover 110, the lower outer cover 120 and the auxiliary inner cover 130 may be formed in the plurality of air cells 135. Through these spot fused portions 116, the plurality of air cells 135 may be formed to be foldable even in the state in which they are filled with air.

Due to this fact, the shock-absorbing packaging material 100 may be formed to be folded into a shape capable of surrounding an article and accommodate the article. As an example, in the case of the shock-absorbing packaging material 100 illustrated in FIG. 8, the plurality of air cells 135 may be folded into a clockwise 90 degrees-rotated U shape through the spot fused portions 116 even in the state in which they are filled with air, whereby it is possible to easily package the article.

After folding the shock-absorbing packaging material 100 illustrated in FIG. 8 such that a front half and a rear half of the shock-absorbing packaging material 100 overlap with each other, by mutually fusing the third longitudinal fused portions 133 formed at both side edges of the folded shock-absorbing packaging material 100, it is possible to construct a shock-absorbing packaging material of a pocket shape. Even in this case, as the air cells 135 are folded by the spot fused portions 116 formed in the plurality of air cells 135, with air filled in the air cells 135, it is possible to form the shock-absorbing packaging material of the pocket shape in which a space for accommodating an article is formed.

Moreover, besides the example illustrated in FIG. 8, by changing the positions of spot fused portions formed in the air cells of a shock-absorbing packaging material, it is possible to form various types of foldable shock-absorbing packaging materials such as a pad type shock-absorbing packaging material and a pocket type shock-absorbing packaging material, depending on a design option.

Figure 9:
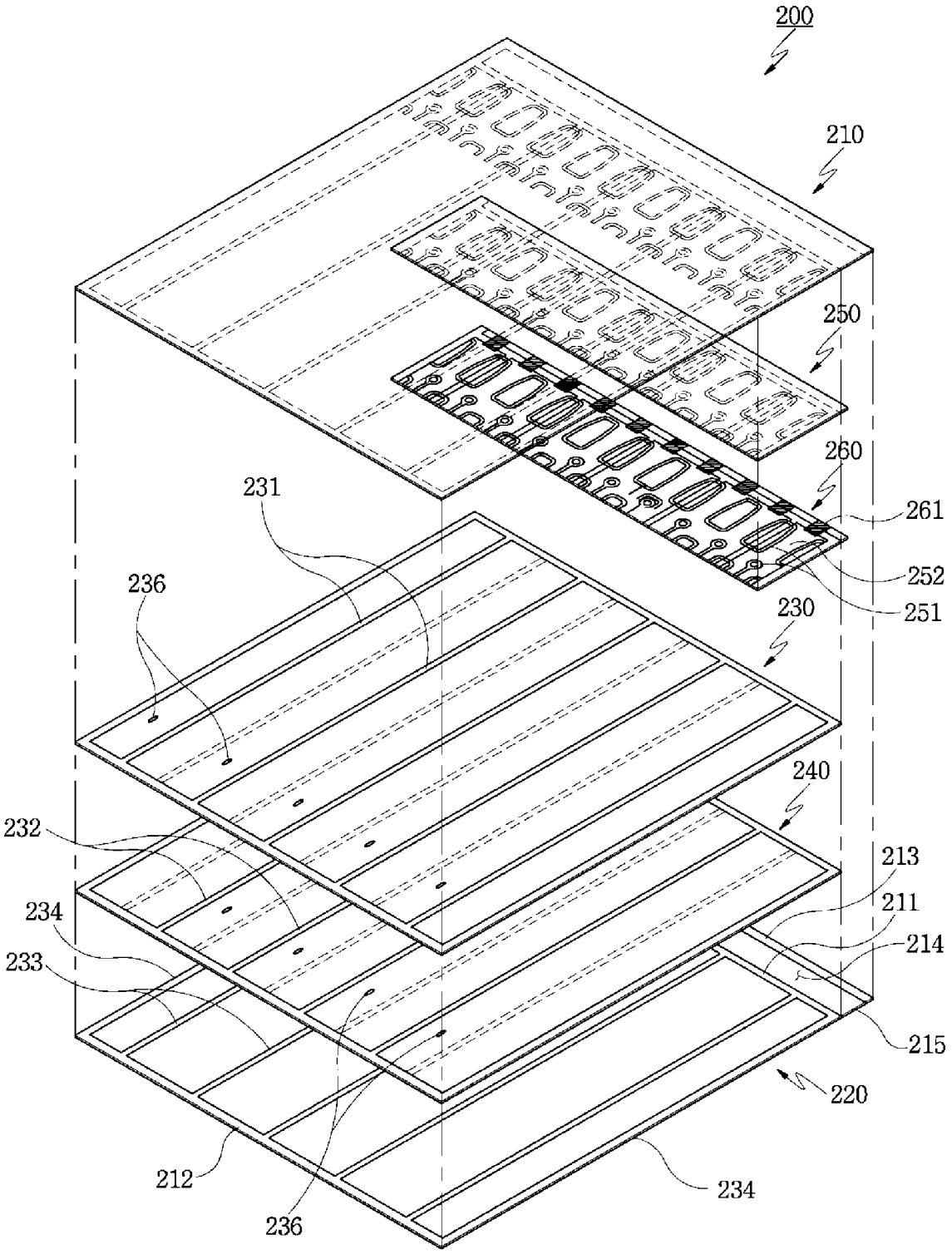
FIG. 9 is an exploded perspective view illustrating the construction of a shock-absorbing packaging material having multi-layered air cells in accordance with a second embodiment of the present disclosure.
Figure 10:
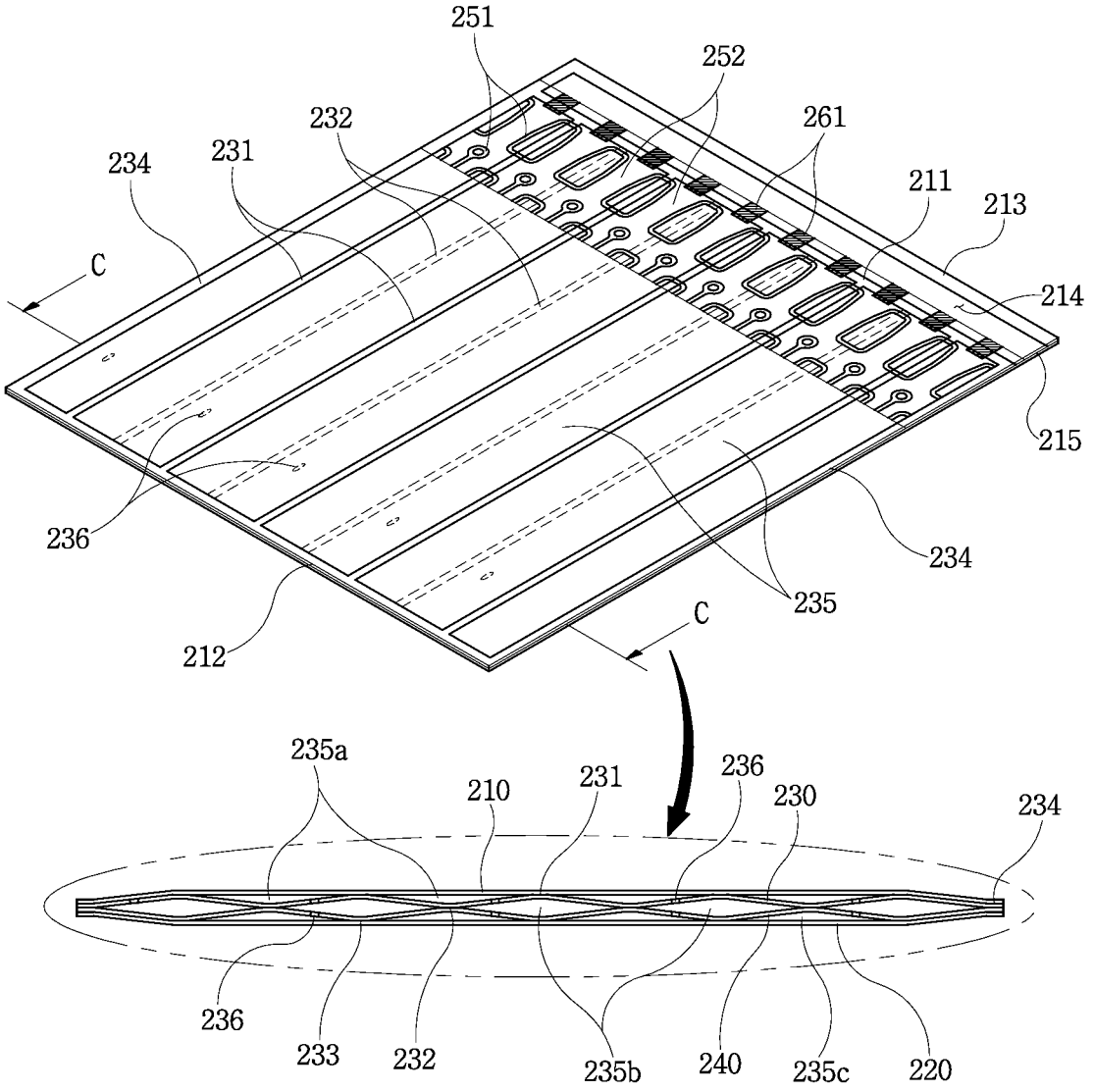
FIG. 10 is an assembled perspective view illustrating the construction of the shock-absorbing packaging material having multi-layered air cells in accordance with the second embodiment of the present disclosure.
Figure 11:
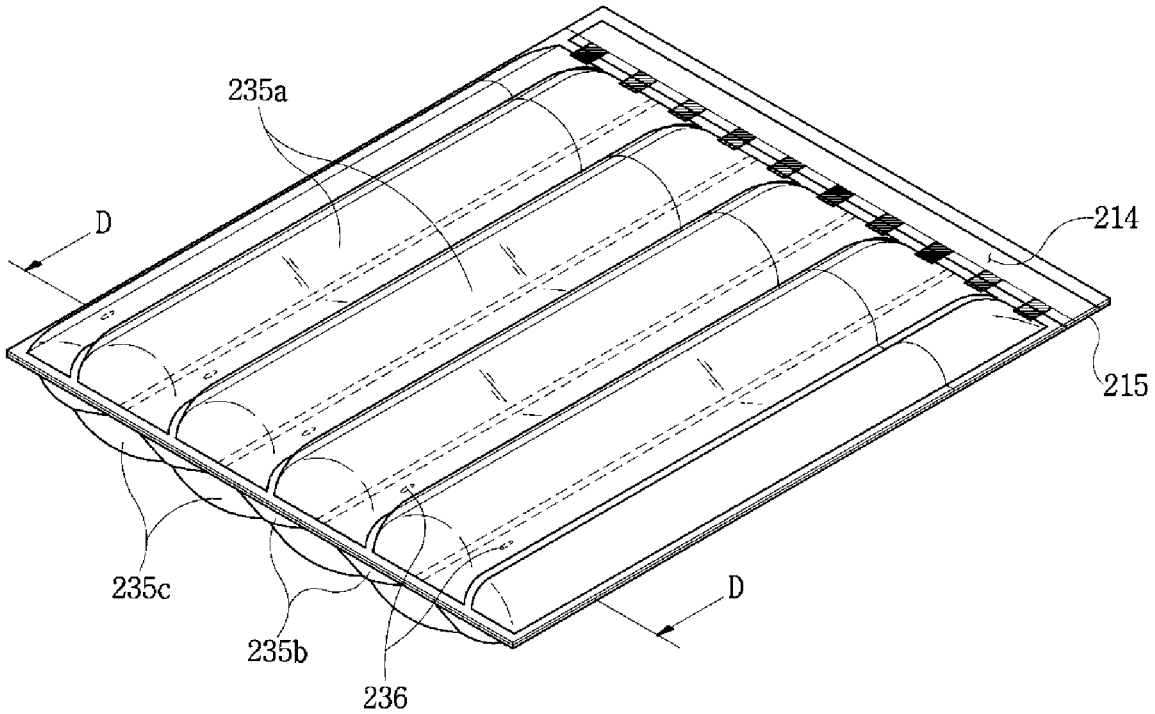
FIG. 11 is a view illustrating a state in which air is filled in the shock-absorbing packaging material having multi-layered air cells in accordance with the second embodiment of the present disclosure.
Figure 12:
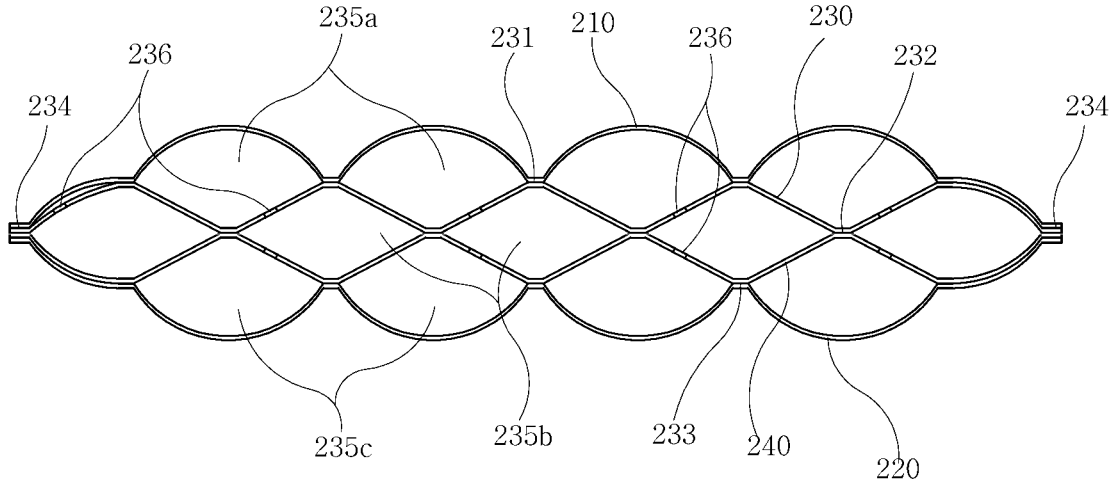
FIG. 12 is a cross-sectional view taken along the line D-D of FIG. 11, illustrating the structure of the air cells of the shock-absorbing packaging material which is in an air-filled state, in accordance with the second embodiment of the present disclosure.

FIG. 9 is an exploded perspective view illustrating the construction of a shock-absorbing packaging material having multi-layered air cells in accordance with a second embodiment of the present disclosure, FIG. 10 is an assembled perspective view illustrating the construction of the shock-absorbing packaging material having multi-layered air cells in accordance with the second embodiment of the present disclosure, FIG. 11 is a view illustrating a state in which air is filled in the shock-absorbing packaging material having multi-layered air cells in accordance with the second embodiment of the present disclosure, and FIG. 12 is a cross-sectional view taken along the line D-D of FIG. 11, illustrating the structure of the air cells of the shock-absorbing packaging material which is in an air-filled state, in accordance with the second embodiment of the present disclosure.

As shown in FIGS. 9 to 12, a shock-absorbing packaging material 200 having multi-layered air cells in accordance with a second embodiment of the present disclosure is constructed by including an upper outer cover, a lower outer cover, an upper inner cover, a lower inner cover and an auxiliary inner cover, in the same manner as the shock-absorbing packaging material 100 having multi-layered air cells in accordance with the first embodiment. However, the shock-absorbing packaging material 200 having multi-layered air cells according to the second embodiment has a difference from the shock-absorbing packaging material 100 having multi-layered air cells according to the first embodiment in that two folds of auxiliary inner covers are provided and thus a plurality of air cells 235 of a three-layered structure are formed in the shock-absorbing packaging material in such a way as to be stacked in an alternately staggered manner.

Namely, in the case of the shock-absorbing packaging material 200 having the three-layered air cells in accordance with the second embodiment of the present disclosure, one layer of air cells are additionally provided, whereby, when compared to the shock-absorbing packaging material 100 having the two-layered air cells in accordance with the first embodiment, advantages may be provided in that it is possible to obtain a relatively excellent shock-absorbing effect and a relatively excellent effect of keeping an article warm or cold.

Describing in detail the construction and the manufacturing process of the shock-absorbing packaging material 200 having multi-layered air cells in accordance with the second embodiment, as shown in FIGS. 9 and 10, upper and lower auxiliary inner covers 230 and 240 which overlap with each other are stacked on a lower outer cover 220, upper and lower inner covers 250 and 260 which overlap with each other are stacked on the upper and lower auxiliary inner covers 230 and 240, and an upper outer cover 210 is stacked on the upper and lower inner covers 250 and 260. Then, the lower outer cover 220, the overlapped upper and lower auxiliary inner covers 230 and 240, the overlapped upper and lower inner covers 250 and 260 and the upper outer cover 210 which are sequentially stacked as described above are partially fused.

In this regard, in the fusing process, first, the upper outer cover 210, the upper inner cover 250 and the lower inner cover 260 are partially fused at regular intervals in a longitudinal direction to form internal fused portions 251, such that the upper outer cover 210 and the upper inner cover 250 are fused to each other and a plurality of air guide paths 252 are formed between the upper inner cover 250 and the lower inner cover 260.

Thereafter, as illustrated in FIG. 10, the upper auxiliary inner cover 230 is partially fused to the underside of the upper outer cover 210 to which the upper and lower inner covers 250 and 260 are fused, to form first longitudinal fused portions 231 at regular intervals, and the lower auxiliary inner cover 240 is partially fused to the underside of the upper auxiliary inner cover 230 to form second longitudinal fused portions 232 at regular intervals in an alternately staggered manner with respect to the first longitudinal fused portions 231.

In addition, the lower outer cover 220 is partially fused to the underside of the lower auxiliary inner cover 240 to form third longitudinal fused portions 133 at regular intervals in such a manner that the third longitudinal fused portions 133 are disposed to face the first longitudinal fused portions 231 and are alternately staggered with respect to the second longitudinal fused portions 232.

That is to say, as illustrated in the cross-sectional view of FIG. 10 taken along the line C-C of the perspective view of FIG. 10, the first longitudinal fused portions 231 which fuse the upper outer cover 210 and the upper auxiliary inner cover 230 and the third longitudinal fused portions 233 which fuse the lower auxiliary inner cover 240 and the lower outer cover 220 are disposed to face each other, and the second longitudinal fused portions 232 fuse the upper auxiliary inner cover 230 and the lower auxiliary inner cover 240 in the longitudinal direction along middle lines between the first longitudinal fused portions 231 which are fused at the regular intervals (or along middle lines between the third longitudinal fused portions 233 which are fused at the regular intervals). As a consequence, the upper auxiliary inner cover 230 and the lower auxiliary inner cover 240 divide the space between the upper outer cover 210 and the lower outer cover 220 in a zigzag pattern by the first longitudinal fused portions 231, the second longitudinal fused portions 232 and the third longitudinal fused portions 233.

In the state in which, as described above, the upper and lower auxiliary inner covers 230 and 240 are fused between the upper outer cover 210 and the lower outer cover 220 by the first to third longitudinal fused portions 231, 232 and 233, both transverse ends of the upper outer cover 210, the upper and lower inner covers 250 and 260, the upper and lower auxiliary inner covers 230 and 240 and the lower outer cover 220 which overlap with one another are simultaneously fused to form fourth longitudinal fused portions 234 and thereby finish both transverse ends of the shock-absorbing packaging material 200, and first and second transverse fused portions 211 and 212 are formed at and thereby finish the front ends and the rear ends of the first to fourth longitudinal fused portions 231, 232, 233 and 234, whereby the plurality of air cells 235 are formed.

The plurality of air cells 235 formed in this way are formed in a three-layered structure in which an upper layer, a lower layer and a middle layer are stacked in an alternately staggered manner between the upper outer cover 210 and the lower outer cover 220, as illustrated in the cross-sectional view taken along the line C-C of FIG. 10, by finishing through fusing the front ends and the rear ends of the first to fourth longitudinal fused portions 231, 232, 233 and 234 by the first and second transverse fused portions 211 and 212, in the state in which the upper and lower auxiliary inner covers 230 and 240 divide the space between the upper outer cover 210 and the lower outer cover 220 in the zigzag pattern by the first to fourth longitudinal fused portions 231, 232, 233 and 234.

Further, a third transverse fused portion 213 is formed along the front edges of the upper and lower outer covers 210 and 220 forwardly of the first transverse fused portion 211. The third transverse fused portion 213 forms an air introduction path 214 in cooperation with the first transverse fused portion 211. The air introduction path 214 communicates with the plurality of air guide paths 252 through air introduction passages where backing members 261 of the upper and lower inner covers 250 and 260 are formed.

The plurality of air guide paths 252 are formed between the upper and lower inner covers 250 and 260 which are fused to the upper outer cover 210, and communicate with only a plurality of air cells 235*a* which are formed at the upper layer among the plurality of air cells 235 formed in the three-layered structure and stacked in the alternately staggered manner. Due to this fact, as illustrated in FIG. 10, a plurality of air flow holes 236 may be formed through the upper and lower auxiliary inner covers 230 and 240 between the air cells 235*a* of the upper layer, air cells 235*b* of the middle layer and air cells 235*c* of the lower layer such that air introduced into the air cells 235*a* of the upper layer through the air guide paths 252 may flow also into the air cells 235*b* and 235*c* of the middle layer and the lower layer.

As illustrated in FIGS. 10 and 12, since the plurality of air flow holes 236 are formed to allow groups of three air cells 235*a*, 235*b* and 235*c* disposed up, midway and down among the plurality of air cells 235 formed in the three-layered structure to communicate with one another, even in the case where any one air cell pops in the shock-absorbing packaging material 200, an influence is not exerted on the other air cells except air cells grouped and communicated with the popped air cell through corresponding air flow holes 236.

By the above-described construction, if an air introduction nozzle is inserted into an air introduction opening 215 of the shock-absorbing packaging material 200 illustrated in FIG. 9 and air is introduced through the air introduction opening 215, as illustrated in FIGS. 11 and 12, air introduced through the air introduction opening 215 is filled in the plurality of air cells 235*a* formed at the upper layer among the plurality of air cells 235 formed in the three-layered structure, by passing through the air guide paths 252 via the air introduction path 214, and at the same time, air is filled also in the plurality of air cells 235*b* and 235*c* formed at the middle layer and the lower layer, through the plurality of air flow holes 236 formed through the upper and lower auxiliary inner covers 230 and 240.

Even in the shock-absorbing packaging material 200 having multi-layered air cells in accordance with the second embodiment, by forming spot fused portions (see the reference numeral 116 of FIG. 8) which fuse the upper outer cover 210, the lower outer cover 220, the upper auxiliary inner cover 230 and the lower auxiliary inner cover 240, in the plurality of air cells 235, the air cells 235 may be constructed to be capable of being folded even in the state in which air is filled in the air cells 235, whereby it is possible to form various types of foldable shock-absorbing packaging materials such as a pad type shock-absorbing packaging material and a pocket type shock-absorbing packaging material.

As is apparent from the above descriptions, in the shock-absorbing packaging material having multi-layered air cells according to the present disclosure, by forming therein a plurality of air cells of a multi-layered structure which are alternately stacked, when packaging an article using the shock-absorbing packaging material, shock-absorbency is increased through the structure of the air cells of a multi-layered structure, whereby it is possible to more safely protect the packaged article.

In addition, in the case of packaging an article which needs to be kept ward or cold, since heat transfer between the inside and the outside of the shock-absorbing packaging material through portions where the air cells are connected with each other is effectively blocked, an advantage may be provided in that an effect of keeping warm and cold is excellent.

INDUSTRIAL APPLICABILITY

In the shock-absorbing packaging material having multi-layered air cells according to the present disclosure, since a plurality of air cells are formed in a multi-layered structure in which the air cells of respective layers are alternately staggered with each other, excellent shock-absorbency is provided and heat transfer between the inside and the outside of the shock-absorbing packaging material is effectively blocked. As a consequence, the shock-absorbing packaging material may be advantageously used in packaging a fragile article or an article which needs to be kept warm or cold.

While various embodiments have been described above, it will be understood to those skilled in the art that the embodiments described are by way of example only. Accordingly, the disclosure described herein should not be limited based on the described embodiments.

The invention claimed is:

1. A shock-absorbing packaging material comprising:

an upper outer cover and a lower outer cover partially fused to each other, forming air cells therebetween, and forming an air introduction path through which air is introduced from an exterior, forwardly of front ends of the air cells; and an upper inner cover and a lower inner cover interposed between the upper outer cover and the lower outer cover, partially fused to each other, and forming a plurality of air guide paths between the air introduction path and the air cells, wherein one fold of auxiliary inner cover which is partially fused to the upper outer cover and the lower outer cover in an alternately staggered manner is disposed between the upper outer cover and the lower outer cover where the air cells are formed, thereby forming the air cells formed between the upper outer cover and the lower outer cover as a plurality of air cells of a two-layered structure which are stacked in an alternately staggered manner, wherein, in the shock-absorbing packaging material, by disposing the auxiliary inner cover to overlap with an underside of the upper outer cover, first longitudinal fused portions which fuse the upper outer cover and the auxiliary inner cover at regular intervals in a longitudinal direction are formed; by disposing the lower outer cover to overlap with an underside of the auxiliary inner cover, second longitudinal fused portions which fuse the auxiliary inner cover and the lower outer cover at regular intervals in the longitudinal direction in an alternately staggered manner with respect to the first longitudinal fused portions are formed; third longitudinal fused portions which fuse and thereby finish both transverse ends of the upper outer cover, the upper inner cover, the lower inner cover, the auxiliary inner cover and the lower outer cover fused with one another are formed; and front ends and rear ends of the first to third longitudinal fused portions are finished by forming first and second transverse fused portions, whereby the plurality of air cells of the two-layered structure are formed such that an upper layer and a lower layer are stacked in an alternately staggered manner between the upper outer cover and the lower outer cover;

wherein a plurality of air flow holes are formed in the auxiliary inner cover to allow air cells formed in one layer of the two-layered structure to communicate with the air cells of the second layer of the two-layer structure; and wherein the upper and lower inner covers form air guide paths in communication with the air cells formed by one of the first and second longitudinal fused portions, but not both of the air cells formed by the first and second longitudinal fuse portions.

2. The shock-absorbing packaging material according to claim 1, wherein each of the upper outer cover, the lower outer cover and the auxiliary inner cover is formed of any one among 1) a synthetic resin film in which a polyethylene (PE) film and a polyethylene terephthalate (PET) film deposited with aluminum are laminated, 2) a synthetic resin film in which a polyethylene (PE) film, an aluminum (Al) film and a polyethylene terephthalate (PET) film are laminated, 3) a synthetic resin film in which a polyethylene (PE) film, a silica film and a nylon film are laminated and 4) a synthetic resin film in which a polyethylene (PE) film and a urethane film are laminated.

3. A shock-absorbing packaging material comprising:

an upper outer cover and a lower outer cover partially fused to each other, forming air cells therebetween, and forming an air introduction path through which air is introduced from an exterior, forwardly of front ends of the air cells; and an upper inner cover and a lower inner cover interposed between the upper outer cover and the lower outer cover, partially fused to each other, and forming a plurality of air guide paths between the air introduction path and the air cells, wherein two folds of auxiliary inner covers including an upper auxiliary inner cover and a lower auxiliary inner cover are provided between the upper outer cover and the lower outer cover where the air cells are formed, and, by disposing the upper auxiliary inner cover to overlap with an underside of the upper outer cover, first longitudinal fused portions which fuse the upper outer cover and the upper auxiliary inner cover at regular intervals in a longitudinal direction are formed, wherein, by disposing the lower auxiliary inner cover to overlap with an underside of the upper auxiliary inner cover, second longitudinal fused portions which fuse the upper auxiliary inner cover and the lower auxiliary inner cover at regular intervals in the longitudinal direction are formed in an alternately staggered manner with respect to the first longitudinal fused portions, wherein, by disposing the lower outer cover to overlap with an underside of the lower auxiliary inner cover, sixth longitudinal fused portions which fuse the lower auxiliary inner cover and the lower outer cover are formed such that the third longitudinal fused portions are disposed to face the first longitudinal fused portions and are alternately staggered with respect to the second longitudinal fused portions, wherein both transverse ends of the upper outer cover, the upper inner cover, the lower inner cover, the upper auxiliary inner cover, the lower auxiliary inner cover and the lower outer cover which are fused with one another are simultaneously fused and finished to form fourth longitudinal fused portions, and first and second transverse fused portions are formed at and thereby finish front ends and rear ends of the first to fourth longitudinal fused portions, whereby a plurality of air cells of a three-layered structure in which an upper layer, a middle layer and a lower layer are stacked in an alternately staggered manner between the upper outer cover and the lower outer cover;

wherein a plurality of air flow holes are formed in the upper auxiliary inner cover and the lower auxiliary inner cover which allow groups of three air cells disposed up, midway and down among the plurality of air cells formed in the three-layered structure to communicate with one another; and wherein the upper and lower inner covers form air guide paths in communication with the air cells formed by one of the first, second, and third longitudinal fused portions, but not two or more of the air cells formed by the first, second, and third longitudinal fused portions.

4. The shock-absorbing packaging material according to claim 3, wherein the upper and lower auxiliary inner covers are formed of the same material as the upper outer cover and the lower outer cover.

5. The shock-absorbing packaging material according to claim 3, wherein each of the upper outer cover, the lower outer cover and the upper and lower auxiliary inner covers is constructed by a synthetic resin film in which a polyethylene (PE) film and a nylon film are laminated.

6. The shock-absorbing packaging material according to claim 3, wherein each of the upper outer cover, the lower outer cover and the upper and lower auxiliary inner covers is formed of any one among 1) a synthetic resin film in which a polyethylene (PE) film and a polyethylene terephthalate (PET) film deposited with aluminum are laminated, 2) a synthetic resin film in which a polyethylene (PE) film, an aluminum (Al) film and a polyethylene terephthalate (PET) film are laminated, 3) a synthetic resin film in which a polyethylene (PE) film, a silica film and a nylon film are laminated and 4) a synthetic resin film in which a polyethylene (PE) film and a urethane film are laminated.

* * * * *